United States Patent [19]

Oder

[11] Patent Number: 4,830,634

[45] Date of Patent: May 16, 1989

[54] PREPARATION OF COAL SUBSTITUTE OF LOW ASH AND SULFUR

[75] Inventor: Robin R. Oder, Export, Pa.

[73] Assignee: Exportech Company, Inc., New Kensington, Pa.

[21] Appl. No.: 881,652

[22] Filed: Sep. 3, 1986

[51] Int. Cl.[4] ..... C10L 1/32

[52] U.S. Cl. ..... 44/51; 44/15 R; 44/622; 209/5; 209/8; 241/20

[58] Field of Search ..... 44/1 SR, 51, 15 R, 1 A; 209/5, 8; 241/20

[56] References Cited

U.S. PATENT DOCUMENTS

| | | | |
|---|---|---|---|
| 3,932,145 | 1/1976 | Foulke et al. | 44/1 SR |
| 4,152,120 | 5/1979 | Zavitsanos et al. | 44/1 SR |
| 4,217,109 | 8/1980 | Siwersson et al. | 44/1 SR |
| 4,270,927 | 6/1981 | Burk, Jr. | 44/1 SR |
| 4,295,858 | 10/1981 | Sun et al. | 44/1 SR |
| 4,324,560 | 4/1982 | Fonseca | 44/1 SR |
| 4,355,999 | 10/1982 | Masologites | 44/1 SR |
| 4,408,999 | 10/1983 | Nadkarni et al. | 44/1 SR |
| 4,466,362 | 8/1984 | Maxwell et al. | 44/1 SR |
| 4,484,928 | 11/1984 | Keller | 44/1 SR |
| 4,575,418 | 3/1986 | Robbins | 44/1 SR |

*Primary Examiner*—William R. Dixon, Jr.
*Assistant Examiner*—Margaret B. Medley
*Attorney, Agent, or Firm*—Reed Smith Shaw & McClay

[57] ABSTRACT

A process is taught for preparing a coal substitute of low ash level from a composite of coal, mineral matter and pyritic sulfur comprising comminuting the coal composite in an aqueous medium to a size range which promotes the liberation of the mineral matter; subjecting the resulting slurry to fines agglomeration in the presence of a water-insoluble bridging organic liquid; separating the agglomerates from the liquid phase containing the bulk of the mineral matter and a portion of the pyritic sulfur; treating the coal fines by stripping the organic liquid from the fines surface; and redispersing the fines in an aqueous medium having a surface active agent to yield a high solids coal fines slurry so to permit magnetic separation of residual pyritic sulfur and other magnetic mineral matter.

16 Claims, 3 Drawing Sheets

PREPARATION OF COAL SUBSTITUTE OF LOW ASH AND SULFUR

I. BACKGROUND OF THE INVENTION

This invention was made with Government support under Contract No. DE-AC01-84ER80117 and Contract No. DE-AC01-83ER80037 awarded by the Department of Energy. The Government has certain rights in this invention.

If coal is to be used to replace scarce petroleum and natural gas feedstocks, practical methods will have to be developed for removing its mineral and sulfur contaminants. Significant amounts of ash forming minerals occur in coal in sizes down into the micron range, and sulfur occurs both in a mineral form, iron pyrite, and as part of the coal structure, "organic sulfur." Because of these complexities, it is generally believed that effective cleaning without excessive loss of the carbonaceous component will require fine grinding to liberate the micron sized ash forming minerals and iron pyrites.

At present there is no commercial technology for cleaning micronized coal. Conventional cleaning methods based on float and sink principles, such as jigging, concentrating tables and heavy media cycloning, are ineffective for cleaning coal particle sizes much below 150 microns. For particles finer than this size, surface activated forces predominate over body forces, such as buoyancy, and the more traditional methods used to clean coarse coal become ineffective. Further, forth flotation, which is a surface actuated method, is also ineffective for cleaning coal particles finer than 150 microns. This is due in part to the lack of commercial coal flotation technology capable of preparing and using micron sized bubbles.

There is an outstanding opportunity to develop commercial coal cleaning technology applicable to micronized coal. The methodology must be effective at separating micron sized mineral matter and pyritic sulfur from the coal, must be inexpensive, and must be capable of achieving high recoveries of the clean coal fraction.

High Gradient Magnetic Separation (HGMS) is a beneficiation technology which is well suited to cleaning micronized coal. HGMS is attractive because it is now used in commercial cleaning of kaolin clay where the particle size can be typically 90% finer than 2 microns. In the kaolin application, HGMS is effective in separating micron sized and feebly paramagnetic mineral contaminants which discolor the diamagnetic clay. By comparison, iron pyrite is also paramagnetic with magnetic susceptibility similar to that of the titaniferous minerals removed from kaolin while mineral-matter-free coal is diamagnetic as is pure kaolin. Batch operated HGMS using conventional iron-based electromagnet technology is effective in removal of pyrite from micronized coal, but has not been applied commercially because of high capital costs associated with low throughput and because of poor carbon yields.

The magnetization of paramagnetic particles, and correspondingly, the magnetic capture force, increases in proportion to the magnetic field strength. Because of this, the use of high field superconductive magnets can facilitate separation of magnetic particles which are too weak to be captured in conventional separators operating at 20,000 Gauss. Further, efficient magnetic separation of micron sized particles from slurries can be carried out at significantly increased slurry throughput when magnetic fields of the order of 80,000 Gauss are employed. This increase in production rate is only possible with use of high magnetic field strength.

Even with these advantages, the use of innovative superconductive magnets has not been justified heretofore because of practical problems associated with interference by the nonmagnetic mineral matter in the coal. Iron pyrite is weakly paramagnetic and the bulk of the mineral matter in coal is diamagnetic. The presence of this mineral matter, either independent of or associted with the iron pyrite crystals, has caused excessive loading of the magnetic capture surface in the HGMS units so that batch operation is impractical.

The extent to which magnetic methods such as HGMS can be used to provide low sulfur and low ash coal is not known at this time because not all mineral matter in coal is paramagnetic. Clearly, however, conjunctive used of other cleaning technologies applicable to the micron size range and capable of removing the preponderance of the nonmagnetic mineral matter could make magnetic methods such as HGMS more effective.

Coal agglomeration is a method for separating micron sized hydrophilic mineral matter from hydrophobic clean coal. The method can achieve relatively high degrees of mineral matter separation with very high recoveries of the clean carbon component. Unfortunately, however, iron pyrite found in coal exhibits hydrophobic surface characteristics so that it tends to move with the coal in coal agglomeration. Because of this, the coal agglomeration method is not well suited to separation of iron pyrite.

It appears that there is an opportunity to develop coal cleaning technology centered on a combination of the magnetic and the agglomeration technologies. The agglomeration technology would be used to remove the greater portion of the "nonmagnetic" mineral matter and the HGMS method would be used to separate the iron pyrite and other magnetic minerals remaining after agglomeration. Using these combined steps, one expects to be able to prepare both low ash and low sulfur coal.

II. OBJECTS OF THE INVENTION

From the foregoing it will be apparent to the reader that the primary object of the present invention is the provision of novel, improved processes for recovering clean coal from mixtures or composites in which the coal is associated with mineral matter, some of which is magnetic.

It is another object to combine the methods of coal agglomeration and High Gradient Magnetic Separation (HGMS) in order to prepare clean micronized coal having ash and sulfur levels appreciably lower than those obtained by using either fines agglomeration or magnetic separation, alone.

Yet another and very important object of the invention is to provide practical means whereby the use of innovative superconductive magnets becomes possible in cleaning fine coal. Superconductive magnets are of great interest in the minerals processing industry because of the possibility of magnetizing physically large working volumes without consumption of excessive amounts of electrical energy—as would be required with use of conventional iron based electromagnets. Further, superconductive magnets can produce magnetic fields up to 80,000 gauss in practical applications. This level is four times greater than that produced by iron-based electromagnets.

In this invention, we have provided a novel method whereby the ash level of the coal fed to the HGMS unit is lowered sufficiently by coal agglomeration so that high field magnetic separation of the remaining iron pyrite is practical. Further, HGMS operates effectively as a polishing operation for the coal agglomeration stage which is inefficient in separation of iron pyrites.

Still other important objects, features, and advantages of our invention will be apparent to the reader from the foregoing, from the appended claims, and from the ensuring description and discussion taken in conjunction with the accompanying drawing.

III. SUMMARY OF THE INVENTION

Accordingly, a novel process is provided for preparing a coal of low ash level from a composite of coal, mineral matter and pyritic sulfur comprising the steps of: (a) comminuting the coal composite in an aqueous medium to a size range which promotes the liberation of the mineral matter from the composite to form an aqueous fines slurry; (b) subjecting the resulting slurry to fines agglomeration in the presence of a water-insoluble bridging organic liquid being added in a quantity sufficient to substantially fill the voids created upon fines agglomeration; (c) separating the agglomerates from the liquid phase containing the bulk of the mineral matter and a portion of the pyritic sulfur; (d) treating the coal fines with heat sufficient for stripping the organic liquid from the fines surface; and (e) redispersing the fines in an aqueous medium having an added surface active agent to yield a high solids, coal fines slurry with a viscosity sufficiently reduced to permit magnetic separation of residual pyritic sulfur and other magnetic mineral matter.

In another embodiment, it comprising the steps of: (a) comminuting the composite in an aqueous medium to a size range which promotes the liberation of mineral matter from the composite to form an aqueous fines slurry; (b) subjecting the coal fines slurry to agglomeration in an aqueous medium with a water-insoluble, bridging hydrocarbon liquid, being added in a quantity sufficient to substantially fill the voids created upon fines agglomeration, and which are substantially water insoluble and which will meet the fines surfaces; (c) separating the agglomerates from the liquid phase containing the bulk of the mineral matter and a portion of the pyritic sulfur; (d) stripping the organic liquid from the coal fines surface; (e) redispersing the fines in an aqueous medium having a surface active agent to yield a high solids coal fines slurry with a viscosity sufficiently reduced to permit magnetic separation of pyritic sulfur and other magnetic mineral matter; (f) passing the well dispersed aqueous slurry through a slurry-pervious magnetic matrix operatively positioned in a high intensity magnetic field maintained at an average field intensity of from 8 to 80 kilogauss, and a retention time of a least 30 seconds; and (g) retaining the magnetic impurities in the matrix while passing the cleaned coal fines to a collection zone.

In an alternate embodiment, the process serves to prepare a low ash and low pyritic sulfur coal broadly entailing the preparation of micronized coal, in an aqueous solution; agglomerating the coal in the presence of a bridging liquid; separating the bulk of the nonpyritic mineral matter; removing the bridging liquid by stripping; dispersing the coal agglomerates at a high solids level in aqueous media with the aid of a dispersion-promoting and viscosity lowering agent that permits higher than inherent flow rates of the slurry through a magnetic separation zone to permit enhanced magnetic separation of pyritic sulfur and other magnetic mineral matter.

In general, this novel, and economically important, result is obtained by milling or otherwise comminuting raw coal until it has been reduced to a particle size less than ca. 1600 microns. This raw coal is then slurried in a aqueous liquid, typically clean water. Comminution of the raw coal is continued until the raw coal has been resolved into separate, particulate phases of coal and mineral matter. After this comminution step is completed, an agglomerating agent is added to the slurry with agitation. Agitation of the slurry is continued until the coal particles have dissociated from the mineral matter and aqueous phases of the slurry and coalsesced into agglomerates. The agglomerates are recovered from the slurry by water washing (there is virtually 100 percent recovery of the carbonaceous material in this separation).

The work described demonstrates the possibility of separating micronized coal and its mineral matter with use of mixtures of the two exemplary immiscible liquids, water and perchloroethylene (PCE). Hydrophobic coal is preferentially wetted by PCE, and the hydrophilic minerals are preferentially wetted by water. Water and PCE are immiscible; hence, it was possible to separate liberated mineral matter from coal by separation of the liquids, after they have been intimately mixed with the coal and minerals.

Significant separations of coal and mineral have been demonstrated, for the case where coal is agglormerated by PCE in water. In the approach studied most extensively, the coal is micronized in water and is then agglomerated by addition of PCE. The agglomerated coal fines are recovered by washing over a screen. Liberated mineral matter is dispersed in the water phase and passes through the screen. Most of the iron pyrites has been observed to remain with the coal agglomerates.

High Gradient Magnetic Separation (HGMS) is then effective in removal of most of the pyrites not separated from the micronized coal in the agglomeration operation. The data has indicated that redispersion of the coal before magnetic separation yields the best results. The fines feed for this step can be dispersed in water, PCE, or a solvent such as methanol. All three liquids showed good results. Of the three, the best results in this work were obtained for magnetic separation in water.

For example, Upper Freeport Seam and Pittsburgh Seam coals were studied. The micronizing was carried out in a stirred ball mill or in jar mills. The grinding chambers were blanketed in inert gas. The size consists prepared are generally 90% finer than 20 microns and the mass median particle diameters are in the range of 4 to 13 microns.

The ash and sulfur characteristics of micronized coals treated by the disclosed process are shown in Table I. The micronized coals were first agglomerated using PCE as bridging liquid, then redispersed in water and cleaned by magnetic separation. The quality of the recovered coal which has been attrited and agglomerated is shown in the second column. The agglomeration stage rejects up to 69% of the mineral matter and 68% of the pyritic sulfur, with combustible yield (C.Y). in excess of 98%. Overall, ash rejections up to 89%, and pyritic sulfur rejections up to 84%, have been obtained, with C.Y. recoveries between 76 and 83%. This resulted when the agglomerated product is treated by high field HGMS, employing medium grade, stainless steel matrices.

The separations process is unique in several aspects. First, PCE is a commercially readily-available nonflammable bridging fluid which is easy to use because it is immiscible in, and is heavier than, water, and because it has a low heat of vaporization. Secondly, by redispersion after agglomeration, the entrapped paramagnetic mineral matter that was not removed in the agglomeration step is released for capture in the magnetic separator. The efficiency of magnetic separation is plainly improved by the bulk removal of nonmagnetic mineral matter in the first agglomeration step.

The approach of agglomeratin of coal in water is only one proven possibility, using the two immiscible liquids. Indeed, there is no indication from the data presented herein that these values represent the lowest limits. Optimization of the process on specific coals offers the possibility of efficient preparation of clean products with even lower ash and sulfur values for these coals.

IV. PREFERRED EMBODIMENT OF THE INVENTION

Figure 1:
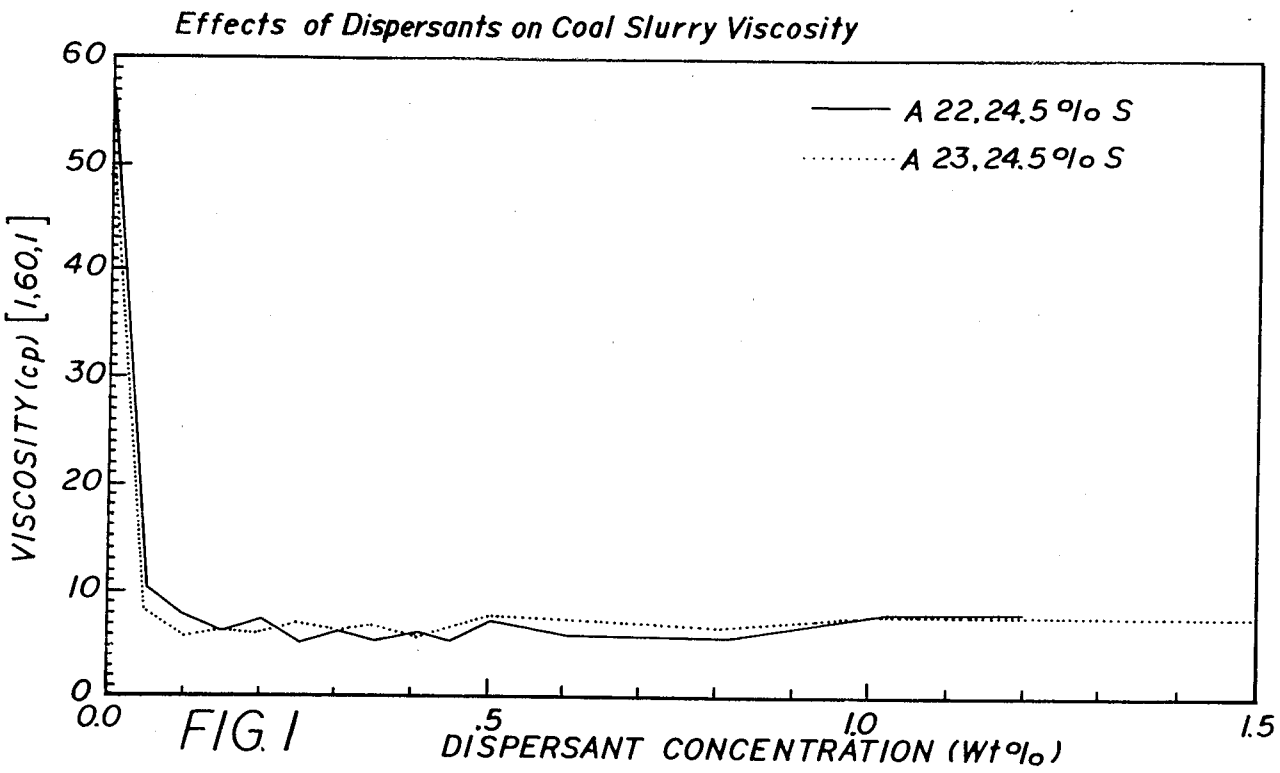
FIG. 1 shows the viscosity effects of certain dispersants used with slurries of coal fines.

Work was carried out to determine the effects of the process parameters believed to be most important. The results discussed in the following represent the best information available.

The coals used in the test work were first size reduced to nominal 20 microns top size. The size reduction was carried out at 40 wt.% solids in distilled deaerated water, using either a batch operated stirred ball mill or a 1.9 liter ceramic jar mill. Stainless steel burnishing balls 3/16" were used in both mills.

Table II shows size analysis of coals micronized in the stirred ball mill. Size distribution measurements were made using a Leeds and Northrup Microtrac. The size distribution of coals ground in a jar mill are given in Table III.

A. Agglomeration

Experiments were performed to determine the effects of the following variables on agglomeration product quality and recovery:

1. Agitation Speed and Time
2. PCE Concentration (by wt.% of coal)
3. Particle Size
4. pH Adjustments 1. Agitation Speed and Time Agglomeration experiments utilized a 14 speed Blender and a 200 mesh U.S. series 8" sieve.

Measurements were made of rpm and time for blending both before and after addition of PCE. Freeport Middling coal was used for this work, and PCE was fixed at 75 wt.%. The following speeds and times yielding the lowest ash were chosen as the best conditions:

(a) 1 minute at Blender setting #8.
(b) PCE added
(c) 1 minute at Blender setting #8.
(d) 3 minute at Blender setting #14.
(e) 1 minute at Blender setting #8.

Unloaded blender operating conditions are: Blender setting #8=8600 RPM and Blender setting #14=20,500 RPM.

These conditions were used throughout the remainder of the testing.

2. PCE Concentration

PCE concentration was varied from 10 wt.% to 150 wt.%, while other variables were held constant. Weight recovery was excessively low at PCE concentrations below 45 wt.% . Agglomerates were observed to form at concentrations up to approximately 120 wt.% PCE. At higher concentrations a continuous PCE coal phase forms and agglomerates no longer appear. The lowest ash agglomerates were formed at 112 wt.% PCE, for all three coals tested.

Table IV shows the best result for PCE agglomeration achieved in the present work. For these data, the material was micronized in a jar mill employing 3/16 inch stainless steel media. Two hour grinds were used in preparing the Upper Freeport coals, and a two and one half hour grind was used in preparing the Pittsburgh #8 coal. The pH of the pulp fed to the jar mill was, 8.05, 8.1 and 8.15 for the Freeport clean, midds and Pittsburgh clean coals, respectively.

3. Particle Size

Experiments were carried out to determine the effects of particle size on agglomeration performance. Proper choice of final particle size is important. Results indicate grinding of dispersed slurries under alkaline conditions to a particle size finer than 10 microns yields better liberation and ash rejection in agglomeration and HGMS.

The results shown in Table III were obtained for material prepared in a jar mill at pH approximately 8. Typical mean particle sizes range from 4 to 5.7 microns as shown in Table III. The best agglomeration results obtained, for coal prepared in the stirred ball mill, were 7.34% ash for Freeport middling, 4.35% ash for Freeport clean, and 3.69% ash for Pittsburgh clean coal. The overall performance of agglomeration and subsequent HGMS improves as particle size is reduced below 8–10 micron mean particle diameter for the Upper Freeport and Pittsburgh #8 coals. Typical particle sizes for this material (see Table II) ranged from 8 to 13 microns.

Combustible yield is calculated using the relationship:

$$\text{Combustible yield (\%)} = \text{weight recovery (\%)}\left[\frac{1-(\text{Product ash})/100}{1-(\text{Feed ash})/100}\right]$$

The weight recovery is calculated using the relationship weight:

$$\text{Recovery (\%)} = \left[\frac{\text{Refuse ash} - \text{Feed ash}}{\text{Refuse ash} - \text{Product ash}}\right] \times 100$$

4. pH Adjustments

Experiments were carried out to determine the effects of pH on agglomeration performances. Freeport middling coal was used. The pH was adjusted in 0.5 increments from pH 6.0 to pH 9.0. After size reduction in the stirred ball mill, agglomerations were carried out using 100 wt.% PCE on coal. Product ash was found to vary only 0.2% from pH 7.0 to pH 9.0. Since most agglomerations were conducted within this range, pH appears less important than other process parameters such as particle size.

B. Redispersion Prior to Magnetic Separation

Exploratory measurements were carried out using a modified Frantz magnetic separator to determine the liquid best suited to magnetic separation. Water, methanol, and perchloroethylene were investigated.

For these measurement, coal was agglomerated, dried, and then radiluted in each of the liquids. Samples were either poured or pumped through a canister developed for use with the Frantz magnet. The canister was 10 inches long, one inch wide and 3/32 inch deep. It was packed to 6% volume occupancy with medium grade #430 stainless steel wool. Approximately two grams of coal were processed during each run and then analyzed for ash and weight recovery.

During this work, it was discovered that redispersion was the key to good magnetics separations. With no redispersion, water slurries were observed to plug the canister matrix. The full redispersion, including agglomerate breaking and addition of dispersant solved this problem and made significant improvements in magnetic separator performance.

Survey measurements of the effects of dispersants on the viscosity of suspensions of micronized coal in water were made. A series of dispersants was studied including Sodium-hexameta-phosphate, Sodium-tripolyphosphate (STPP), Tetra-sodium-pyrophosphate (TSPP), and materials supplied by Diamond Shamrock; dispersant 44, dispersants A22 and A23 and polymer 115. Some measured viscosities are compared in Table V.

Use of Diamond Shamrock dispersants A22 and A23 resulted in the lowest viscosity of all the dispersants surveyed. Their effects on the Pittsburgh 8 coal from the Emerald Mine are shown in FIG. I, where viscosity at nominal 22% solids is plotted versus dispersant concentration. These dispersants are anionic high molecular weight condensed polynuclear hydrocarbons. The sodium of A22 is replaced by an ammonium group for A23. They appear to be equally powerful dispersants for all coals considered.

The use of Diamond-Shamrock dispersant (A22 or A23) resulted in low viscosity slurries at solids up to approximately 40%. The variation of slurry viscosity with solids concentration is given in Table VI for 0.4 wt% A23 on Upper Freeport Middlings Coal.

For the magnetic separation test work with water, agglomerates were washed with methanol in the blender at high RPM for particle release; this was followed by filtering and drying. The coal samples were then diluted to 10% solids in water, 0.4% A23 was added, and the samples sheared in the blender for one minute to assure good redispersion.

Table VII summarizes the results of redispersion and liquid-medium selection tests. All tests used 14.83% ash Upper Freeport middling coal as fed to the agglomeration. A modified Frantz separator was used for the magnetic separation tests.

Figure 2:
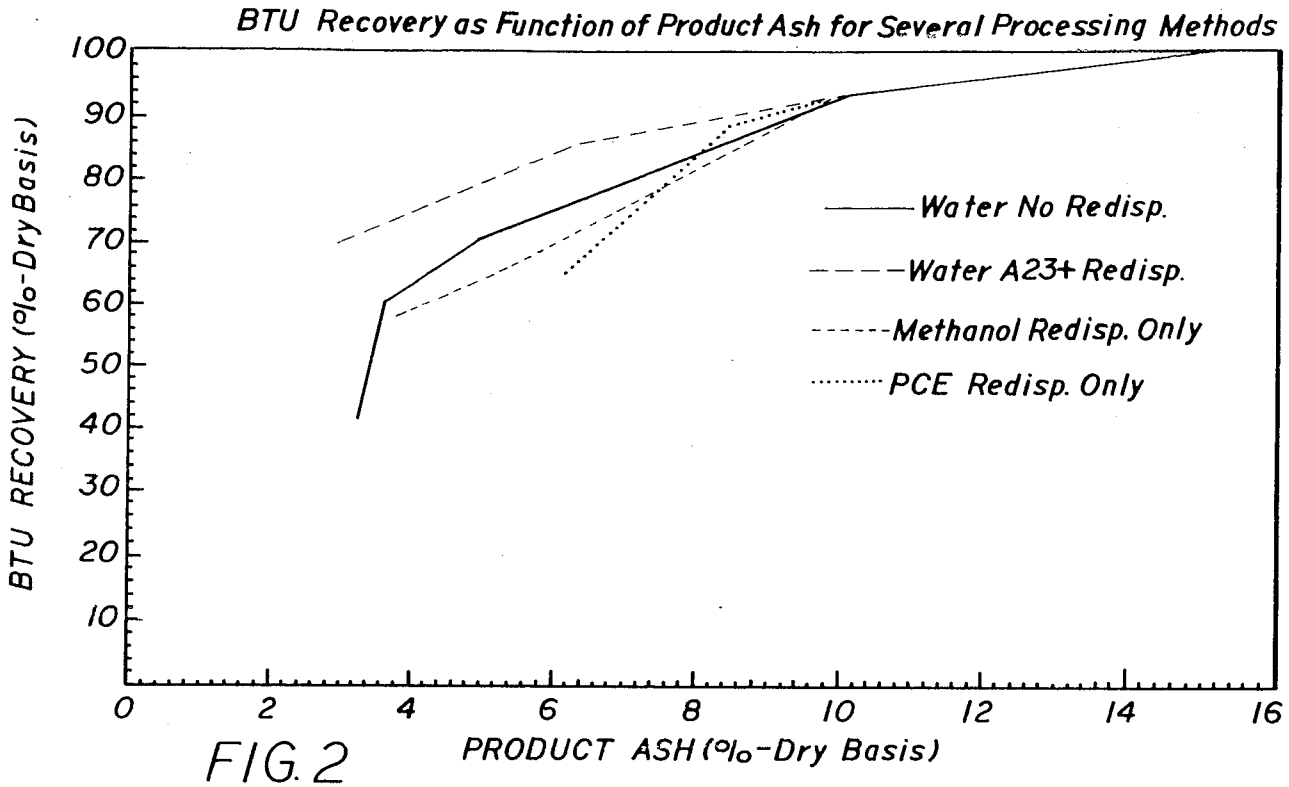
FIG. 2 shows the effects of liquid and redispersion on fines agglomeration and magnetic separations.

The Btu recovery and ash rejection data of Table VII are plotted in FIG. 2. It was apparent that HGMS conducted using methanol-washed and water-dispersed coal is the best approach to post-agglomeration processing.

The foregoing data reflect the best results are achieved by processing in water, using D-S A23, as the dispersant. Alternately, D-S 092 (another condensed polynuclear hydrocarbon) was used as a dispersant for magnetic separation employing an organic liquid. The '092 did lower ash by an additional 15%, and improved yield slightly when used in PCE.

Table VIII summarizes results of redispersion using D-S 092 in PCE as an organic medium. These tests were performed on Freeport middling coal with feed ash of 14.83% to agglomeration. Magnetic separation tests were carried out with use of the modified Frantz separator.

As can be seen from Tables VII and VIII, washing with methanol and redispersion are key steps in the process. Without them, magnetic separation for pyrite removal did not work well. The agglomerates must be redispersed and mineral matter liberated so as to obtain good separations with use of magnetic methods.

C. High Gradient Magnetic Separator (HGMS) Experiments

The HGMS testing was directed at developing an overview of magnetic removal of pyrites as a second processing step following agglomeration. Following the results of the screening tests using the modified Frantz separator, water was the only liquid used in the magnetic test work.

The measurements were carried out using both a 15T water cooled Bitter Solenoid and a new, 2 inch room temperature access, 15T superconducting magnet built by IGC of Gilderland, N.Y. Both magnetics were capable of producing fields up to 150,000 gauss. The range of experimental parameters covered in the measurements program of Phase I is given in Table XI. The test arrangement is shown in FIG. 3.

High field measurements were made in order to quantify improvements in yield, possible in processing at high field strength, and to establish flow velocity appropriate to commercial processing.

Figure 3:
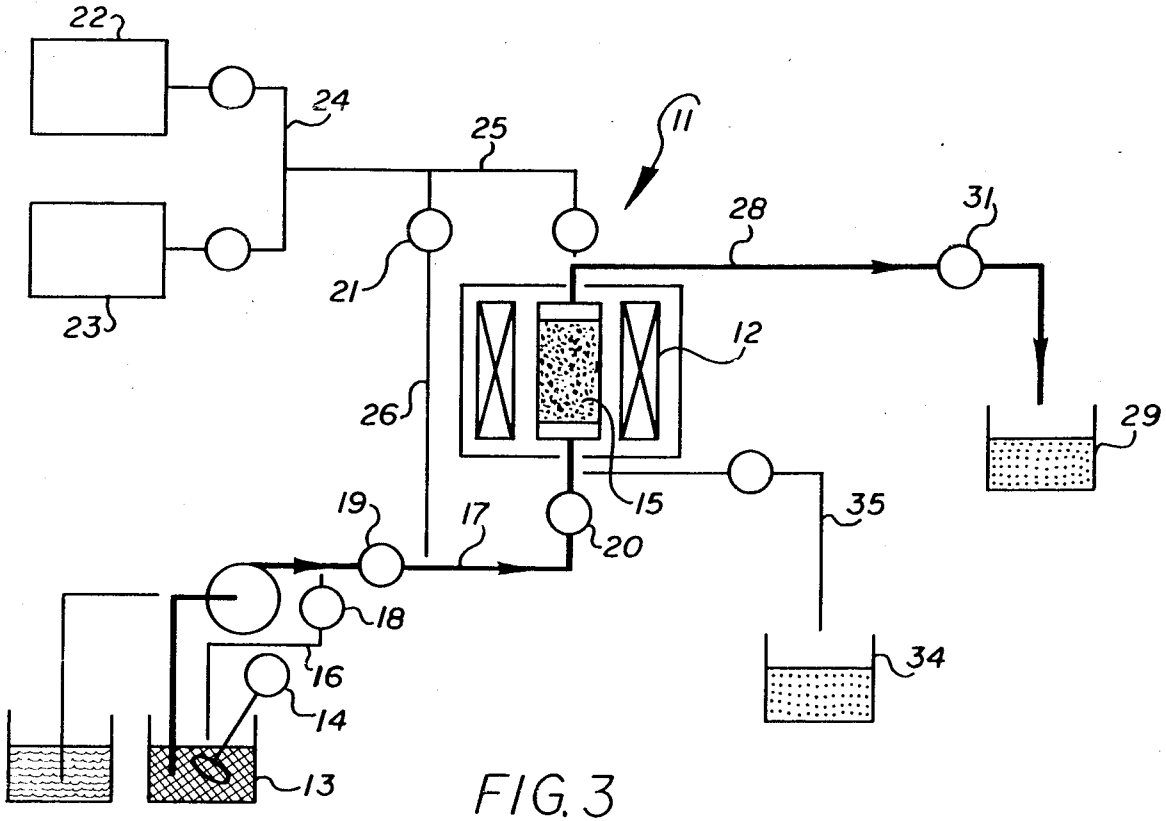
FIG. 3 is a flow diagram for a schematic apparatus for conducting magnetic separations.

Referring now to FIG. 3, a flow diagram for an apparatus for magnetic separation, operating according to the present invention is shown. The magnetic separation device, generally 11, is employed in the form of a solenoidal magnetic coil 12. Magnetic fields up to 15 Tesla are used. In making the discussed measurements, the coal fines feed slurry held in vessel 13 (agitated by stirrer 14 for uniformity) can be pumped to the canister 15 (bottom region) via conduit 16 and 17, each line being provided with a brass ball valve 18, 19 and 20, respectively. The flowthrough is regulated between 0 and 3000 cc per minute.

Slurry flowthrough the canister is controlled by a hand operated manifold valve. A plant water source 22 and a dry nitrogen gas source 23 are connected via conduits 24, 25 and 26 to permit intermittent canister matrix flushing.

A canister is being incorporated into the base of the magnet apparatus. The canister element (not shown) is austenitic made from stainless steel (S.S.). With particular solenoid coil 12 used, the maximum canister diameter was 2 inches OD. Canister length was 4-5/16th inches. The compressed stainless steel wool media was retained by screens (both not shown) at each end of the canister. The slurry flow enters the canister 15 from the bottom via conduit 17 (here a ⅜th inch I.D. (S.S) tube) and exits through a similar conduit 28, disposed at the upper end of the canister, passing to a product vessel 29 through valve 31.

There are variable modes of operation of the apparatus to collect the middlings and magnetics. First, the magnet is energized and coal slurry from feed tank 3 is pumped through the canister, containing ferritic stainless steel wool, and then goes into product tank 29. After the magnetic matrix has become fully loaded, then rinsing of the clean coal into the middlings (magnetics) vessel 34 occurs via conduit 35. This is effected by displacing coal in the canister with clean water while the magnet is energized.

This is carried out in one of two ways:

(a) First is to pump rinse water into the top of the magnet, displacing the middlings downwardly into the middlings container 30, alternately, the last canister can be displaced into product container 29, by puming rinse water upwardly through the canister and then into the product container. The flow velocity of this rinse water is substantially the same as the slurry flow velocity slurring separation.

After clean coal has been displaced from the canister matrix, then flushing of the magnetics out of canister 15 occurs, while the magnetic field is off. By using high velocity flush water (24) this can be effected in either of two ways. First, flushing from the top of the canister moves the magnetics into the magnetics vessel 34, or, flushing from the bottom of the canister 15 into the magnetic vessel 34 can occur, by replacing the product container by the magnetic container. This merely involves appropriate setting of the several valves provided in the lines.

All agglomerations were 112.5 wt.% PCE, and 0.4 wt.% A23 dispersant, based on dry coal. Table X summarizes the results of agglomerations performed.

Samples of agglomerated coal were prepared for HGMS by methanol washing, filtering, drying, dilution, and redispersion. Experiments were carried out as with the as-received coals to determine effects of magnetic field and flow rate on clean coal quality and recovery.

Table XI summarizes the results of the two step process of agglomeration and HGMS. In the table, the symbols Tesla and T represent a magnetic field strength of 10,000 gauss.

The data generally indicate that best magnetic performance is achieved in high flow velocity processing. Processing under these conditions requires magnetic fields greater than the 2T, not possible in conventional iron-return magnets. The results achieved with this non-optimized investigation indicate that clean coals of nominal 1.4 to 2.3% ash can be prepared with combustible yields greater than 70%. Total sulfur rejections in excess of 47% were achieved for each of the coals.

The capabilities of sequential agglomeration and HGMS are shown herein as being complementary. The agglomeration stage removes the bulk of the mineral matter and some pyrites. The HGMS stage is a polishing operation specific to iron pyrite and other residual magnetic impurities.

By first removing much of the mineral matter by agglomeration, the combustible yield is improved for the HGMS state. This is illustrated in Table XII where the percentage of combustible yield loss per percent ash removal is compared for HGMS applied to agglomeration feed and agglomeratin product coals. All separations were carried out at H=7.88 Tesla and V=1.26 cm/sec. For each coal, the percent of combustible yield per percent of ash removal, was reduced by lowering the feed coal ash level.

Using high field HGMS allows significant improvement in overall process combustible yield. The trend in combustible yield and product ash recovery, with increasing field strength and flow velocity, is illustrated in Table XIII for the three coals. The data correspond to processing at H/v=6.1±10%.

The improvement in combustible yield with increasing flow velocity is greatest for magnetic separator feed which has previously been cleaned by PCE agglomeration. While minor variations are apparent in the product ash levels, the measured values are generally constant to within ±30% for processing at constant H/v where v is changed by 750%.

D. Effects of the Order of Agglomeration and Magnetic Separation

Experiments were carried out to explore the effects of the order in which magnetic separation and agglomeration are carried out. As-received coals size, reduced to 7–9 micron mean particle diameter with dispersant present, were processed by high field HGMS. The clean coal from HGMS was then agglomerated.

The noncommutativity of the two operations is illustrated in the data of Table XIV. Comparison of the elements of Table XIV indicates that agglomeration followed by HGMS is the better overall sequence.

TABLE I

Quality of Micronized Coals Prepared by Agglomeration and Magnetic Separation

| | As-Received Coal | Agglomerated Product | Percent Reduction | Treated Product | Overall Reduction Percent |
|---|---|---|---|---|---|
| | | Freeport Clean Coal | | | |
| Ash % | 6.92 | 2.87 | 58.5 | 1.24 | 78.9 |
| Total Sulfur % | 1.11 | 0.94 | 15.3 | 0.74 | 33.3 |
| Pyritic Sulfur % | 0.49 | 0.30 | 38.8 | 0.11 | 77.6 |
| Combustible Yield, %* | | 98.1 | | 79.0 | |
| | | Freeport Middling Coal | | | |
| Ash % | 15.37 | 4.69 | 69.5 | 1.65 | 89.3 |
| Total Sulfur % | 1.78 | 0.98 | 44.9 | 0.76 | 57.3 |
| Pyritic Sulfur % | 1.11 | 0.35 | 68.5 | 0.18 | 83.8 |
| Combustible Yield, %* | | 99.1 | | 76.5 | |
| | | Pittsburgh #8 Clean Coal | | | |
| Ash % | 6.16 | 2.54 | 58.8 | 1.40 | 77.3 |
| Total Sulfur % | 1.71 | 1.37 | 19.9 | 1.01 | 40.9 |
| Pyritic Sulfur % | 0.87 | 0.57 | 34.5 | 0.24 | 72.4 |
| Combustible Yield, %* | | 99.9 | | 83.1 | |

*Calculated from ash and weight recovery measurements.

TABLE II

Size Measurements of Coals Attrited in a Stirred Ball Mill

| Coal | Grinding Time (Minutes) | Particle Diameter (Microns) 50% Finer Than | 90% Finer Than |
|---|---|---|---|
| Freeport Middling | 10 | 8 | 22 |
| Freeport clean | 12 | 8 | 23 |
| Pittsburgh | 10 | 13 | 40 |

TABLE III

Size Measurements of Coals Attrited in a Jar Mill

| Coal | Grinding Time (Minutes) | Particle Diameter (Microns) 50% Finer Than | 90% Finer Than |
|---|---|---|---|
| Freeport Middling | 120 | 4.06 | 9.50 |
| Pittsburgh Clean | 120 | 5.74 | 13.6 |

TABLE IV

Single Stage Agglomeration with Perchloroethylene (PCE) Concentration: 112% (Wt. PCE/Wt. Dry Coal)

| Coal | Ash (Wt. %) Feed | Product | Weight Recovery, % | Ash Reduction, % | Combustible Yield |
|---|---|---|---|---|---|
| Freeport Middling | 15.53 | 4.78 | 86.02 | 69.22 | 97.0 |
| Freeport Clean | 6.79 | 2.64 | 93.96 | 61.1 | 98.1 |
| Pittsburgh #8 Clean | 5.92 | 2.40 | 96.16 | 59.5 | 99.8 |

TABLE V

Effects of Dispersants on Viscosity[1] of Coal in Water

| Coal | Wt. % Solids | Dispersant* | Concentration** | Viscosity (cp) |
|---|---|---|---|---|
| Upper Freeport Midds | 34.6 | No | NA | 2800 |
| Same | 34.6 | STPP | 0.2–0.5 wt. % | 1800 |
| Pittsburgh #9 Raw Coal | 38.9 | STPP | 1~2 wt. % | 300 |
| Pittsburgh #9 Raw Coal | 24.8 | STPP | .8~1.4 wt. % | 12 |
| Pittsburgh #9 Raw Coal | 24.5 | A23 or A24 | .05~1.5 wt. % | 7 |

[1]Measured with Brookfield Viscometer
*STPP: Sodium Tripolyphosphate
**Based on weight of dry coal

TABLE VI

Effect of A23 (.4 wt. % based on dry coal) on Viscosity of Upper Freeport Middlings at Different Solids Levels

| Solids (wt. %) | Viscosity (cp) |
|---|---|
| 10.5 | 3.2 |
| 19.6 | 3.9 |
| 30.2 | 7.2 |
| 39.3 | 28.8 |

TABLE VII

Exploratory HGMS Measurement Using D-S A23 Dispersant

| Media Liquid | Redispersion in Methanol | Dispersant Conc. % | Feed Ash % | Product Ash % | Retention Time (Sec) | Btu Recovery % |
|---|---|---|---|---|---|---|
| Water | No | 0.4 | 10.12 | 3.24 | Pour | 43.7 |
| Water | No | 0.4 | 10.12 | 4.81 | 38 | 74.5 |
| Water | No | 0.4 | 10.12 | 3.60 | 116 | 64.2 |
| Water | Yes | 0.4 | 9.90 | 6.22 | 13.5 | 91.6 |
| Water | Yes | 0.4 | 9.90 | 2.94 | 68 | 74.9 |
| Methanol | Yes | 0 | 9.90 | 4.99 | 21 | 68.5 |
| Methanol | Yes | 0 | 9.90 | 3.79 | 64 | 62.0 |
| PCE | Yes | 0 | 9.90 | 8.38 | 15 | 94.8 |
| PCE | Yes | 0 | 9.90 | 6.12 | 27 | 69.6 |

TABLE VIII

Effect of Diamond-Shamrock O92 Dispersant on HGMS* in PCE

| Media Liquid | Dispersant & Conc. % | Feed Ash % | Product Ash % | Retention Time (Sec) | Rejection Ash % | Btu Recovery % |
|---|---|---|---|---|---|---|
| PCE | 0 | 7.57 | 5.37 | Pour | 29.1 | 71.9 |
| PCE | 0.55-O92 | 7.57 | 4.11 | Pour | 45.7 | 75.0 |
| PCE | 1.01-O92 | 7.57 | 4.23 | Pour | 44.1 | 74.4 |
| Water | 0.4-A23 | 7.57 | 3.30 | Pour | 56.4 | 65.6 |

*Modified Frantz Separator

TABLE IX

Experimental Parameters for Phase I Measurements

| | |
|---|---|
| Magnets | Bitter Solenoid and Compound* Superconducting Solenoid. |
| Magnetic Field Strength | Up to 15 Tesla |
| Canister Length (cm) | 10.95 |
| Canister Volume (cc) | 105 and 125 |
| Flow Velocity (cm/sec) | 0.42 to 3.07 |
| Matrix Packing (%)** | 6 |
| Slurry Solids (wt. %) | 14.8 to 38.4 |
| Slurry Vixcosity (cp) | 3.8 to 31 |

*Niobium Three Tin core with Niobium Titanium compensating coils.
**Medium Grade #430 Felted Stainless Steel Wool Pads

TABLE X

Agglomeration Results
PCE Concentration: 12.5 (PCE/Dry Coal)

| Coal | Ash Feed | Ash Prod | Ash Reduct % | Total Sulfur % Feed | Sulfur % Product | Sulfur Reduct % | Btu Recovery % |
|---|---|---|---|---|---|---|---|
| Freeport Middling | 14.83 | 7.34 | 50.5 | 1.84 | NM | NM | 99.1 |
| Freeport Clean | 6.44 | 4.35 | 32.5 | 1.38 | 1.03 | 25.4 | 99.3 |
| Pittsburgh #8 Clean | 5.97 | 3.69 | 38.2 | 1.69 | 1.39 | 17.8 | 98.3 |

TABLE XI

Summary of Results: Agglomeration Followed by HGMS

| Coal | Feed Coal Ash % | Feed Coal Total Sulfur % | Agglomeration Wt. % Recovery | Agglomeration Ash % | Flow Rate (cc/min) | Mag. Field (Tesla) | H/v (T-s/cm) | HGMS Wt. % Recovery | HGMS Ash % | HGMS Sulfur % | Overall Process Sulfur Reduction % | Overall Process Ash Reduction % | Overall Process Btu Recovery % |
|---|---|---|---|---|---|---|---|---|---|---|---|---|---|
| Freeport Middling | 14.83 | 1.84 | 91.1 | 7.34 | 244 | 1.97 | 5.52 | 67.3 | 2.29 | 0.79 | 57.1 | 84.6 | 70.3 |
| | | | | | 848 | 7.88 | 6.36 | 70.1 | 2.19 | | | 85.2 | 73.3 |
| | | | | | 848 | 14.98 | 11.93 | 66.5 | 1.75 | | | 86.2 | 69.9 |
| | | | | | 1548 | 14.98 | 6.53 | 69.1 | 2.06 | | | 86.1 | 72.4 |
| Freeport Clean | 6.44 | 1.38 | 97.1 | 4.35 | 244 | 1.97 | 5.52 | 72.7 | 1.83 | 0.68 | 50.7 | 71.5 | 74.1 |
| | | | | | 860 | 7.88 | 6.27 | 74.0 | 1.74 | | | 73.0 | 75.5 |
| | | | | | 860 | 14.98 | 11.76 | * | 1.44 | | | 77.6 | * |
| | | | | | 1580 | 14.98 | 6.4 | 78.7 | 1.43 | | | 77.8 | 80.59+ |
| Pittsburgh #8 Clean | 5.97 | 1.69 | 96.0 | 3.69 | 218 | 1.97 | 6.19 | 79.3 | 1.97 | 0.89 | 47.3 | 67.0 | 79.3 |
| | | | | | 840 | 7.88 | 6.42 | 83.6 | 1.86 | | | 68.8 | 83.74+ |
| | | | | | 1580 | 14.98 | 6.42 | 84.6 | 2.07 | 0.89 | 47.3 | 65.3 | 84.68 |

*Not Available
+Best Overall Process Results

TABLE XII

Effect of Ash Level on Combustible Yield
H = 7.88 Tesla; V = 1.28 cm/sec

| Ash % Feed | Ash % Product | Combustible Yield % | Ash Reduction % | % Loss of Combustible Yield per % Ash Removal |
|---|---|---|---|---|
| Freeport Clean Coal: | | | | |
| 6.44 | 3.89 | 80.4 | 39.60 | 0.50 |
| 4.35 | 1.74 | 75.5 | 60.00 | 0.41 |
| Freeport Middling Coal: | | | | |
| 14.83 | 3.36 | 57.5 | 77.34 | 0.55 |
| 7.34 | 2.19 | 73.3 | 70.16 | 0.38 |
| Pittsburgh #8 Clean Coal: | | | | |
| 5.97 | 3.36 | 84.5 | 43.72 | 0.35 |
| 3.69 | 1.86 | 83.7 | 49.59 | 0.33 |

TABLE XIII

Effect of Flow Velocity Upon Combustible Yield
at H/v = 6.1 Tesla-sec/cm (±10%)

| Feed Ash % | Flow Rate cm/sec | H Tesla | H/v (T-s/cm) | Product Ash % | Comb. Yield % | Comb. Yld. Improvement % |
|---|---|---|---|---|---|---|
| Freeport Clean Coal: | | | | | | |
| 6.44 | 0.36 | 1.97 | 5.47 | 4.07 | 68.8 | — |
| 6.44 | 1.26 | 7.88 | 6.25 | 3.89 | 80.4 | 17 |
| 6.44 | 2.30 | 14.78 | 6.43 | 4.15 | 86.1 | 25 |
| 4.35 | 0.36 | 1.97 | 5.47 | 1.83 | 74.1 | — |
| 4.35 | 1.26 | 7.88 | 6.28 | 1.74 | 75.5 | 2 |
| 4.35 | 2.31 | 14.78 | 6.40 | 1.43 | 80.6 | 9 |
| Freeport Middling Coal: | | | | | | |
| 14.28 | 0.36 | 1.97 | 5.47 | 3.59 | 51.8 | — |
| 14.28 | 1.29 | 7.88 | 8.11 | 3.36 | 57.5 | 11 |
| 14.28 | 2.30 | 14.78 | 6.43 | 4.29 | 58.4 | 13 |
| 7.34 | 0.36 | 9.97 | 5.47 | 2.29 | 70.3 | — |
| 7.34 | 1.24 | 7.88 | 6.35 | 2.19 | 73.3 | 4 |
| 7.34 | 2.26 | 14.78 | 6.54 | 2.06 | 72.4 | 3 |
| Pittsburgh #8 Clean Coal: | | | | | | |
| 5.97 | 0.34 | 1.97 | 5.79 | 3.59 | 77.8 | — |
| 5.97 | 1.32 | 7.88 | 5.97 | 3.36 | 84.5 | 9 |
| 5.97 | 2.30 | 14.78 | 6.43 | 3.21 | 86.9 | 12 |
| 3.69 | 0.32 | 1.97 | 6.16 | 1.97 | 79.3 | — |
| 3.69 | 1.23 | 7.88 | 6.41 | 1.86 | 83.7 | 6 |
| 3.69 | 2.30 | 14.78 | 6.43 | 2.07 | 84.6 | 7 |

TABLE XIV

HGMS and Agglomeration Sequence Comparison

| | Freeport Middling | Freeport Clean | Pittsburgh #8 Clean |
|---|---|---|---|
| As-Received, Ash % | 14.83 | 6.44 | 5.97 |
| Agglomeration First, | | | |

TABLE XIV-continued

HGMS and Agglomeration Sequence Comparison

| | Freeport Middling | Freeport Clean | Pittsburgh #8 Clean |
|---|---|---|---|
| As-Received, Ash % | 14.83 | 6.44 | 5.97 |
| then HGMS: | | | |
| Produce Ash % | 1.75 | 1.43 | 1.86 |
| Ash Rejection % | 88.2 | 77.8 | 68.8 |
| Combustible Yield, % | 69.9 | 81.2 | 85.3 |
| HGMS First, then Agglomeration | | | |
| Product Ash % | 2.55 | 2.78 | 2.08 |
| Ash Rejection % | 82.8 | 56.8 | 65.2 |
| Combustible Yield, % | 51.2 | 75.0 | 86.4 |

What is claimed is:

1. A process for preparing a coal of low ash level from a composite of coal, mineral matter and pyritic sulfur, said ash level being between 1–2% by weight ash in said coal, comprising the steps of:

(a) comminuting the composite in an aqueous medium to a size range which promotes the liberation of mineral matter from the composite to form an aqueous fines slurry, said size range comprising particles at least 50% of which are finer than 8 microns and at least 90% of which are finer than 22 microns, said slurry having a minimum solids content of 30% by weight;

(b) subjecting the coal fines slurry to agglomeration in an aqueous medium with a water-insoluble, bridging hydrocarbon liquid, being added in a quantity sufficient to substantially fill the voids created upon fines agglomeration;

(c) separating the agglomerates from the liquid phase containing the bulk of the mineral matter and a portion of the pyritic sulfur;

(d) stripping the bridging hydrocarbon liquid from the fines surface in order to permit full redispersion through agglomerate breaking;

(e) redispersing the fines in an aqueous medium having a surface active agent to yield a high solids coal fines slurry with a viscosity reduced to below about 100 centipoise to permit magnetic separation of pyritic sulfur and other magnetic mineral matter;

(f) passing the well dispersed aqueous slurry through a slurry-pervious magnetic matrix operatively positioned in a high intensity magnetic field maintained at an average field intensity of from 8 to 80 kilogauss, and a retention time of at least 30 seconds;

(g) retaining the magnetic impurities in the matrix while passing the cleaned coal fines to a collection zone; and (h) concentrating the treated coal fines from the aqueous liquid in which the particles were dispersed to produce a slurry suitable for direct combustion.

2. The process according to claim 1 wherein the organic liquid stripping is effected with heat.

3. A process according to claim 1 wherein the viscosity-reducing surfactant is selected from one of the an anionic condensed polynuclear hydrocarbon, in a concentration range from 0.005 to 1.0 weight percent, based on the dry weight of the fines slurry.

4. A process as defined in claim 2 wherein said composite coal is comminuted in an during aqueous slurry perdominantly to a top size of not more than 22 microns.

5. A process as defined in claim 2 wherein the ratio of composite solids to water in the comminution and first slurrying step is not more than 45 weight percent.

6. A process according to claim 2 wherein the bridging liquid used during agglomeration is selected from halogenated hydrocarbons.

7. A process according to claim 6 wherein the bridging liquid is mixed with the coal fines slurry in an amount ranging from 50 to 120 weight percent based on the dry weight of the coal slurry.

8. A process according to claim 2 wherein the bridging liquid is selected from alkanes of 5 to 8 carbon atom chain.

9. The process according to claim 6 wherein the composite coal is comminuted in an aqueous slurry predominantly to a top size of not more than 22 microns, and the ratio of composite solids to water in the comminution and first slurring step is not more than 45 weight percent.

10. The process according to claim 9 wherein the bridging liquid used during agglomeration is selected from the group consisting of halogenated hydrocarbons and alkanes of 5 to 8 carbon atom chain.

11. The process according to claim 10 wherein the bridging liquid is mixed with the coal fines slurry in an amount ranging from 50 to 120 weight percent based on the dry weight of the coal slurry.

12. The process according to claim 11 wherein the viscosity-reducing surfactant is an anionic condensed polynuclear hydrocarbon, in a concentration range from 0.005 to 1.0 weight percent, based on the dry weight of the fines slurry.

13. A process for preparing a coal of low ash level from a composite of coal, mineral matter and pyritic sulfur, said ash level being between 1–2% by weight ash in said coal, comprising the steps of:

(a) comminuting the composite in an aqueous medium to a size range which promotes the liberation of mineral matter from the composite to form an aqueous fines slurry, said comminuted composite having particles at least 50% of which are finer than 8 microns and at least 90% of which are finer than 22 microns, said slurry having a minimum solids content of about 30% by weight and a maximum solids content of about 45% by weight;

(b) subjecting the coal fines slurry to agglomeration in an aqueous medium with a water-insoluble, bridging hydrocarbon liquid, said bridging hydrocarbon liquid being added in a quantity sufficient to substantially fill the voids created upon fines agglomeration, said bridging liquid being selected from the group consisting of halogenated hydrocarbons and alkanes of 5 to 8 carbon atom chain, said bridging liquid being mixed with the coal fines slurry in an amount ranging from 50 to 120 weight percent based on the dry weight of the coal;

(c) separating the agglomerates from the liquid phase containing the bulk of the mineral matter and a portion of the pyritic sulfur;

(d) stripping the bridging liquid from the fines surface in order to permit full redispersion through agglomerate breaking;

(e) redispersing the fines in an aqueous medium having a surface active agent to yield a high solids coal fines slurry having up to 30–35% by weight solids, with a viscosity reduced to below about 100 centipoise to permit magnetic separation of pyritic sulfur and other magnetic mineral matter, said surface active agent comprising an anionic condensed polynuclear hydrocarbon which is added in a concentration range from 0.005 to 1.0 weight percent, based on the dry weight of the fines slurry;

(f) passing the well dispersed aqueous slurry through a slurry-pervious magnetic matrix operatively positioned in a high intensity magnetic field maintained at an average field intensity of from 8 to 80 kilogauss, and a retention time of at least 30 seconds;

(g) retaining the magnetic impurities in the matrix while passing the cleaned coal fines to a collection zone; and (h) concentrating the treated coal fines from the aqueous liquid in which the particles were dispersed to produce a slurry suitable for direct combustion.

14. The process according to claim 13 wherein the bridging liquid comprises perchloroethylene, which is added at a concentration of about 112% by weight based on the dry weight of the coal.

15. The process according to claim 13 wherein the organic liquid stripping is effected by heat.

16. The process according to claim 13 wherein the coal is washed in methanol following agglomeration.

* * * * *

UNITED STATES PATENT AND TRADEMARK OFFICE

CERTIFICATE OF CORRECTION

PATENT NO. : 4,830,634

DATED : May 16, 1989

INVENTOR(S) : Robin R. Oder

It is certified that error appears in the above-identified patent and that said Letters Patent is hereby corrected as shown below:

Column 1, line 29 delete the word --forth-- and insert the word "froth".

Column 2, line 6 delete the word --associted-- and insert the word "associated".

Column 2, line 11 delete the word --provide-- and insert the word "prepare".

Column 2, line 14 delete the word --used-- and insert the word "use".

Column 3, line 6 delete the word --ensuring-- and insert the word "ensuing".

Column 3, line 52 delete the word --a-- and insert the word "at".

Column 4, line 12 delete the word --coalsesced-- and insert the word "coalesced".

Column 4, line 28 delete the word --agglormerated-- and insert the word "agglomerated".

Column 5, line 10 delete the word --agglomeratin-- and insert the word "agglomeration".

Column 7, line 8 delete the word --radiluted-- and insert the word "rediluted".

Column 7, line 56 delete the word --fed-- and insert word "feed".

Column 11, Table III, line 16, delete the number --9.50-- and insert number "9.05".

Column 12, Table X, line 56 delete the number --12.5-- and insert the number "12.5%".

UNITED STATES PATENT AND TRADEMARK OFFICE

CERTIFICATE OF CORRECTION

PATENT NO. : 4,830,634

DATED : May 16, 1989

INVENTOR(S) : Robin R. Oder

It is certified that error appears in the above—identified patent and that said Letters Patent is hereby corrected as shown below:

Column 3, line 31 delete the word --comprising-- and insert the word "comprises".

Column 4, line 5, delete the word --a-- and insert the word "an".

Column 4, line 34, delete the word --has-- and insert the word "have".

Column 7, line 7, delete the word --measurement-- and insert the word "measurements".

Column 12, table IX, line 49, delete the word --vixcosity-- and insert the word "viscosity".

Signed and Sealed this

Twenty-fifth Day of December, 1990

*Attest:*

*Attesting Officer*

HARRY F. MANBECK, JR.

*Commissioner of Patents and Trademarks*